US007607192B2

(12) United States Patent
Flora et al.

(10) Patent No.: US 7,607,192 B2
(45) Date of Patent: Oct. 27, 2009

(54) CLEANING IMPLEMENT, CLEANING SYSTEM COMPRISING A CLEANING IMPLEMENT, AND METHOD FOR CLEANING HARD SURFACES

(75) Inventors: Jeffery Lawrence Flora, Mason, OH (US); Douglas Michael McGahan, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 842 days.

(21) Appl. No.: 11/189,243

(22) Filed: Jul. 26, 2005

(65) Prior Publication Data

US 2006/0016037 A1 Jan. 26, 2006

Related U.S. Application Data

(60) Provisional application No. 60/591,189, filed on Jul. 26, 2004.

(51) Int. Cl.
*A47L 13/10* (2006.01)

(52) U.S. Cl. ..... 15/231; 15/228; 15/209.1; 15/229.6; 15/224

(58) Field of Classification Search ..... 15/228, 15/209.1, 104.02, 229.6, 231, 224
See application file for complete search history.

(56) References Cited

U.S. PATENT DOCUMENTS

| | | | | |
|---|---|---|---|---|
| 3,465,377 | A | 9/1969 | Thomas | |
| 3,656,202 | A | 4/1972 | Paton | |
| 4,349,933 | A | 9/1982 | Thompson | |
| 6,098,239 | A | 8/2000 | Vosbikian | |
| 6,245,413 | B1 | 6/2001 | Kenmochi et al. | |
| 6,513,184 | B1 | 2/2003 | Brown et al. | |
| 6,550,092 | B1 | 4/2003 | Brown et al. | |
| 6,555,192 | B1 | 4/2003 | Tanaka et al. | |
| 7,047,586 | B2 * | 5/2006 | Shimada et al. | 15/104.002 |
| 7,386,907 | B2 * | 6/2008 | Otsuka et al. | 15/104.002 |
| 2002/0050016 | A1 | 5/2002 | Willman et al. | |

(Continued)

FOREIGN PATENT DOCUMENTS

| | | | |
|---|---|---|---|
| EP | 1 086 648 | A1 | 3/2001 |

(Continued)

*Primary Examiner*—Shay L Karls
(74) *Attorney, Agent, or Firm*—Thibault Fayette; Larry L. Huston; Kim W. Zerby

(57) ABSTRACT

The present invention relates a cleaning implement for cleaning hard surfaces, comprising a handle connected to a mop head which is at least partially deformable, the mop head having a leading edge connected to a trailing edge, wherein the mop head comprises a first cavity, said first cavity extending from the leading edge towards the trailing edge, said first cavity forming an opening only adjacent the leading edge when said mop head is in contact with a hard surface to be cleaned, said opening having a width of between about 50% and about 100% of the entire length of the leading edge. The present invention further relates to a cleaning system for cleaning hard surfaces, comprising the cleaning implement, and a cleaning sheet removably attached to the mop head of said cleaning implement. The present invention further relates to a method of cleaning a hard surface comprising the step of wiping the surface with the cleaning system. The cleaning implements and cleaning systems of the present invention have improved cleaning performance, especially improved pick-up capability of larger soil particles.

23 Claims, 6 Drawing Sheets

U.S. PATENT DOCUMENTS

| | | | |
|---|---|---|---|
| 2003/0017051 | A1 | 1/2003 | Coutandin et al. |
| 2004/0025271 | A1 | 2/2004 | Shimada et al. |

FOREIGN PATENT DOCUMENTS

| | | | |
|---|---|---|---|
| EP | 0 945 251 | B1 | 12/2003 |
| JP | 6-311954 | | 11/1994 |
| WO | WO 02/41747 | A1 | 5/2002 |
| WO | WO 2004/041051 | A2 | 5/2004 |
| WO | PCT/US2005/025144 | | 11/2005 |

* cited by examiner

CLEANING IMPLEMENT, CLEANING SYSTEM COMPRISING A CLEANING IMPLEMENT, AND METHOD FOR CLEANING HARD SURFACES

CROSS REFERENCE TO RELATED APPLICATION

This application claims the benefit of U.S. Provisional Application No. 60/591,189, filed on Jul. 26, 2004.

FIELD OF THE INVENTION

The present invention relates to cleaning implements, and cleaning systems for cleaning hard surfaces, especially dry dusting of hard surfaces such as floors.

BACKGROUND OF THE INVENTION

Cleaning systems for dry dust-type cleaning of hard surfaces, especially floor surfaces, are well known in the art. An example of such a cleaning system is Swiffer™, sold by the Procter & Gamble Company. This cleaning system has an implement which comprises a handle connected to a mop head via a universal joint, and is to be used together with a disposable cleaning sheet which needs to be attached to the mop head.

These type of cleaning systems were specifically designed for convenient and easy cleaning of hard surfaces, especially dry dust-type cleaning of hard floor surfaces, and to replace the vacuum cleaner, brush and dustpan. However, these type of cleaning systems still suffer from a number of problems.

One problem of these cleaning systems is that the cleaning sheet gets quickly saturated at the leading edge. Another problem of these cleaning systems is that they are not effective at picking up larger soil particles. As a result, these particles together with dust and other dry soil are piling up in front of the mop head's leading edge. Both the saturated sheet area at the leading edge, and the dust pile prevent more dust, dry soil or larger soil particles to be picked up by the cleaning sheet, leaving a relatively large area of the sheet unused. As such, the cleaning sheet can not be used to its full extent. Another problem of these cleaning systems is that, because of their great maneuverability, dust and dry soil and soil particles escape along the sides of the mop head during the cleaning operation, especially when the mop head is turned from one direction to another. As a result, a dust pile and large particles remain on the floor after the cleaning operation, requiring additional cleaning steps or cleaning tools such as a vacuum cleaner, or a brush and dustpan, to provide complete dust and soil removal.

Thus, there still remains an unmet consumer need, that is, a cleaning system which is convenient and easy to use, which is capable of providing complete dust and dry soil removal, without the need for additional cleaning steps or cleaning tools, and which makes full use of the cleaning capabilities of the cleaning sheet.

Some attempts have already been made to address some of these problems.

U.S. patent application 2004/0025271, assigned to 3M Innovative Properties Company describes a cleaning device with a cleaning portion comprising a flexible member which is attached to a rigid plastic holding plate. The cleaning portion has a cleaning cloth surface for the pick-up of fine dust, and an adhesive surface for the pick-up of larger particles, both of which can individually come in contact with the surface to be cleaned. The cleaning portion is attached to a handle via a pivot, and the cleaning device has a stopper for restricting the movement of the handle. The adhesive surface does not contact the surface to be cleaned until the handle is tilted beyond a predetermined angle. One problem of this cleaning device is that larger particles could be trapped by the adhesive surface in the region where the adhesive surface and cleaning cloth surface contact each other. As a result, a dust pile is building up, thereby restricting the further pick up of fine dust by the cleaning cloth surface. Also, when moving the cleaning portion in side directions, dust and soil may escape along the sides of the cleaning portion. And tilting the handle for bringing the adhesive surface in contact with the surface to be cleaned, is inconvenient for the user.

U.S. Pat. No. 3,465,377, assigned to Kimberly-Clark Corporation, describes a cleaning mop having a mop head provided with a cushion means. The cushion means include spaced rows of resiliently deformable material, each row having a multiplicity of depending projections. The depending projections of alternate rows lie intermediate the projections of adjacent rows to serve as stops and provide closed paths to dust, preventing dust passage through the mop width. The projections have a small width in relation to the length of the mop head, and as a result, larger particles may block the projections, thereby restricting further pick-up of dust and particles. The stoppers prevent fine dust from moving towards the center and the back of the mop head, thereby leaving a large area of the cleaning sheet less used, or even unused.

The present invention is directed to overcoming these problems and shortcomings of the prior art.

It is therefore an object of the present invention to provide a cleaning implement, and a cleaning system, which is convenient in use, and has an improved cleaning performance.

It is another object of the present invention to provide a cleaning implement, and a cleaning system, which is capable of providing complete dust and dry soil removal, without the need for additional cleaning steps or cleaning tools.

It is yet another object of the present invention to provide a cleaning implement, and a cleaning system, which is capable of picking up fine dust as well as larger dry soil particles.

It is another object of the present invention to provide a cleaning implement, and a cleaning system, which is capable of collecting and retaining a dust pile during the cleaning operation, without preventing further pick-up of fine dust by a cleaning sheet.

It is yet another object of the present invention to provide a cleaning implement, and a cleaning system, which is capable of making improved use of the cleaning sheet.

SUMMARY OF THE INVENTION

The present invention relates a cleaning implement for cleaning hard surfaces, comprising a handle connected to a mop head which is at least partially deformable, the mop head having a leading edge connected to a trailing edge, wherein the mop head comprises a first cavity, said first cavity extending from the leading edge towards the trailing edge, said first cavity forming an opening only adjacent the leading edge when said mop head is in contact with a hard surface to be cleaned, said opening having a width of between about 50% and about 100% of the entire length of the leading edge.

The present invention further relates to a cleaning system for cleaning hard surfaces, comprising the cleaning implement, and a cleaning sheet removably attached to the mop head of said cleaning implement.

The present invention further relates to a method of cleaning a hard surface comprising the step of wiping the surface with the cleaning system. The method preferably further comprises the step of moving the mop head in a direction such that particles are collected and retained within said first cavity. The method also preferably comprises the step of pressing the mop head against the surface to be cleaned, during the wiping operation, and/or after the wiping operation.

DETAILED DESCRIPTION OF THE INVENTION

Figure 1:
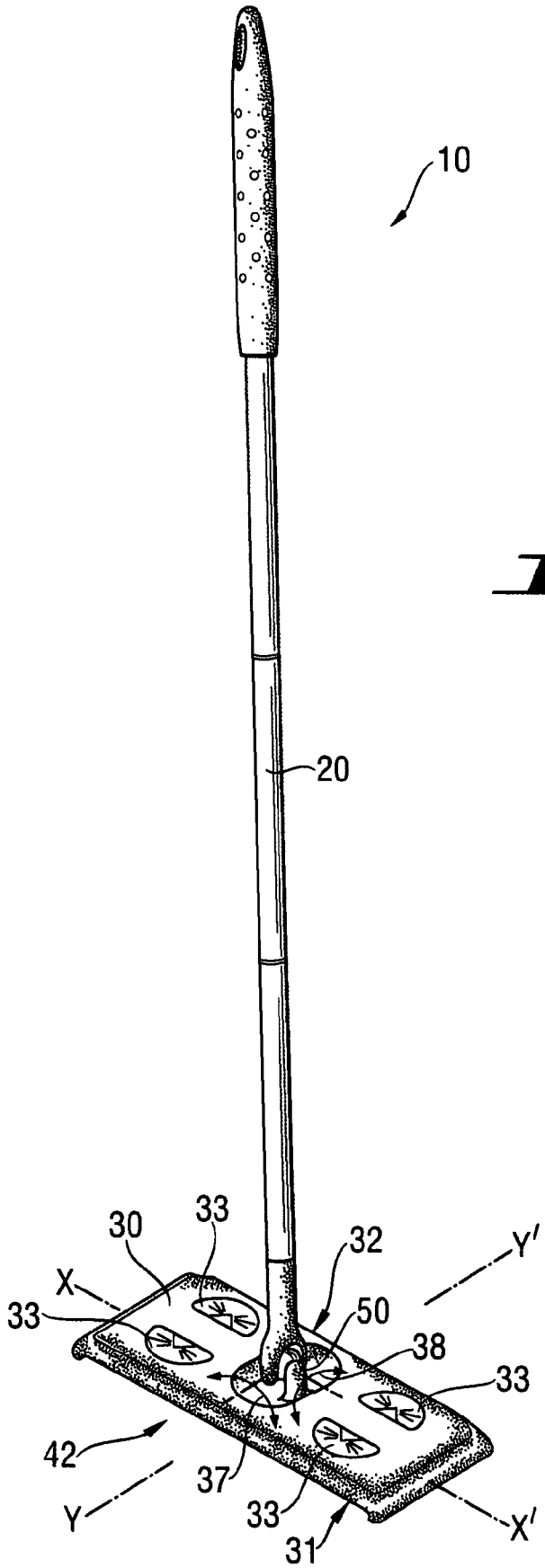
FIG. 1 is a perspective view of a cleaning implement according to the present invention.

A. Definitions:

As used herein, the term "X-Y dimension" refers to the plane orthogonal to the thickness of the mop head, or a component thereof. The X and Y dimensions usually correspond to the length and width, respectively, of the mop head or a mop head component.

As used herein, the term "Z-dimension" refers to the dimension orthogonal to the length and width of the mop head of the present invention, or a component thereof. The Z-dimension usually corresponds to the thickness of the mop head.

As used herein, the term "layer" refers to a member or component of a cleaning sheet whose primary dimension is X-Y, i.e., along its length and width. It should be understood that the term "layer" is not necessarily limited to single layers or sheets of material. Thus the layer can comprise laminates or combinations of several sheets or webs of the requisite type of materials. Accordingly, the term "layer" includes the terms "layers" and "layered."

For purposes of the present invention, an "upper" layer of a cleaning sheet is a layer that is relatively further away from the surface that is to be cleaned (i.e., in the implement context, relatively closer to the implement handle during use). The term "lower" layer conversely means a layer of a cleaning sheet that is relatively closer to the surface that is to be cleaned (i.e., in the implement context, relatively further away from the implement handle during use).

B. Cleaning Implement:

The cleaning implement 10 of the present invention comprises a handle 20 which is connected to a mop head 30. The mop head 30 is at least partially deformable, preferably at least partially compressible. The mop head 30 is preferably rotatably connected to the handle 20. One or more pivotable joints 50 may interconnect the handle 20 of the cleaning implement 10 with the mop head 30. A preferred joint 50 is a universal joint which comprises two rotational axes which allow the handle 20 to pivot in directions 37 and 38, as shown in FIG. 1.

The mop head 30 has a leading edge 31 connected to a trailing edge 32, as shown in FIG. 1. As used herein, the term "leading edge" refers to the edge of the mop head 30 which leads the mop head 30 when it is moved in a forward direction away from its user. Likewise, the term "trailing edge" refers to the furthest edge of the mop head 30 which trails the mop head 30 when it is moved in a forward direction away from its user. For most cleaning implements, the leading edge 31 and the trailing edge 32 are substantially parallel to the longitudinal axis of the mop head 30, wherein the longitudinal axis is the axis along the length of the mop head 30. A preferred shape in the X-Y dimension for a mop head 30 is a substantially rectangular shape, however other shapes are possible. For example, the mop head 30 can have an eye-shape, a circular shape or a triangular shape. For circular shaped mop heads, the leading edge is considered to be one half of the circumference, the trailing edge being the opposite half of the circumference. For triangular shaped mop heads, the leading edge can be one of the 3 sides defining the triangle, if that side is leading the mop head when it is moved in a forward direction. The remaining 2 other sides of the triangle are then considered to be the trailing edge. If one of the 3 sides defining the triangle is a trailing edge, that is, if one of the 3 sides is trailing the mop head when it is moved in a forward direction, then the remaining 2 other sides are considered to be the leading edge.

The mop head 30 also preferably comprises one or more attachment structures 33, as shown in FIG. 1. The attachment structures 33 are configured to receive and retain a cleaning sheet 70 on the mop head 30, during use. Suitable attachment structures 33, but not limited thereto, are flexible structures comprising slits, clamps, hooks and loops (such as e.g. Velcro™), or combinations thereof A preferred attachment structure 33 is described in U.S. Pat. No. 6,305,046 (Kingry, et al.). The attachment structures 33 can be located either on the mop head's 30 upper surface, on its lower surface, on the sides, or a combination thereof.

The mop head 30 comprises at least one cavity which allows to collect, and retain, all types of dry soil, including fine dust, hair, sand, but also larger soil particles such as for example food crumbs, during the cleaning operation. The mop head 30 comprises at least a first cavity 40 as shown in FIGS. 1, 3*a*, 3*b*, and 4*a*, which extends from the leading edge 31 towards the trailing edge 32, and forms an opening 42 only adjacent the leading edge 31 when said mop head 30 is in contact with a hard surface 80 to be cleaned. As such, the opening is only accessible at the leading edge. With "when the mop head 30 is in contact with a hard surface", it is meant that the mop head 30 is placed horizontally on a horizontal hard surface 80, while not contacting any substantially vertical surface, as shown in FIG. 4*a*. The opening 42 has a width of between about 50% and about 100%. Preferably, the opening 42 has a width of less than 100%, but at least about 50%, preferably at least about 70%, more preferably at least about 90%, and most preferably at least about 95% of the entire length of the leading edge 31. Preferred ranges for the opening are between about 70% and about 99%, more preferably between 90% and 98% of the entire length of the leading edge 31. The wider the opening 42, the better fine dust and larger soil particles can be collected in the cavity underneath the mop head 30. If the opening has a width of more than about 25%, but less than 50% of the length of the leading, a cleaning sheet which is attached to the mop head will not conform well to the cavity, thereby reducing the height of the opening at the leading. Although an improved cleaning benefit is still obtained versus cleaning implements of the art, mop heads with a cavity having an opening of 25-50% of the length of the leading edge will show reduced cleaning efficiency and soil removal capacity versus those having an opening of between 50-100% of the length of the leading edge.

Figure 3A:
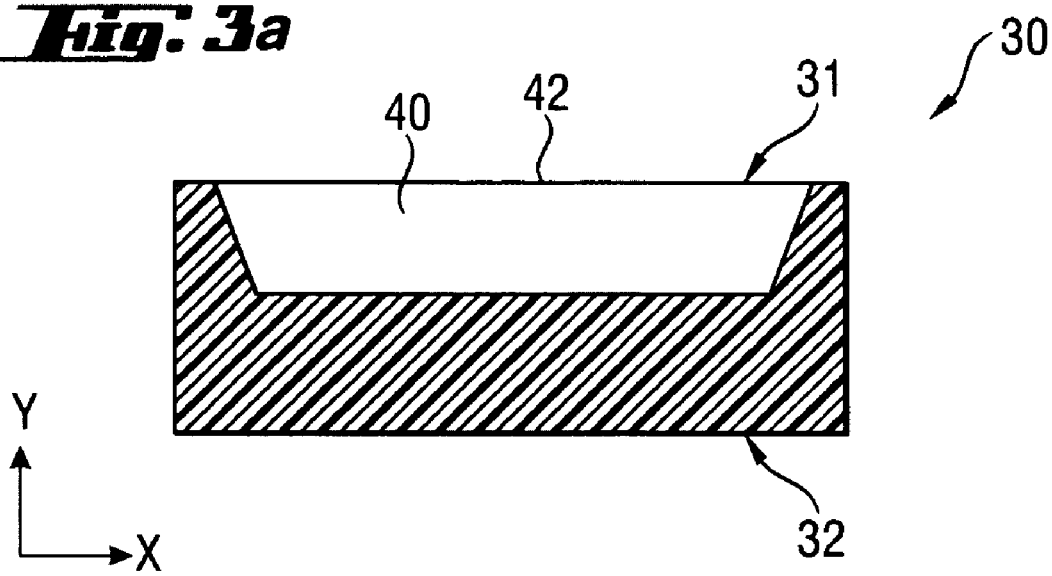
FIG. 3*a* is a cross-sectional view in the X-Y dimension of a mop head according to the present invention.
Figure 3B:
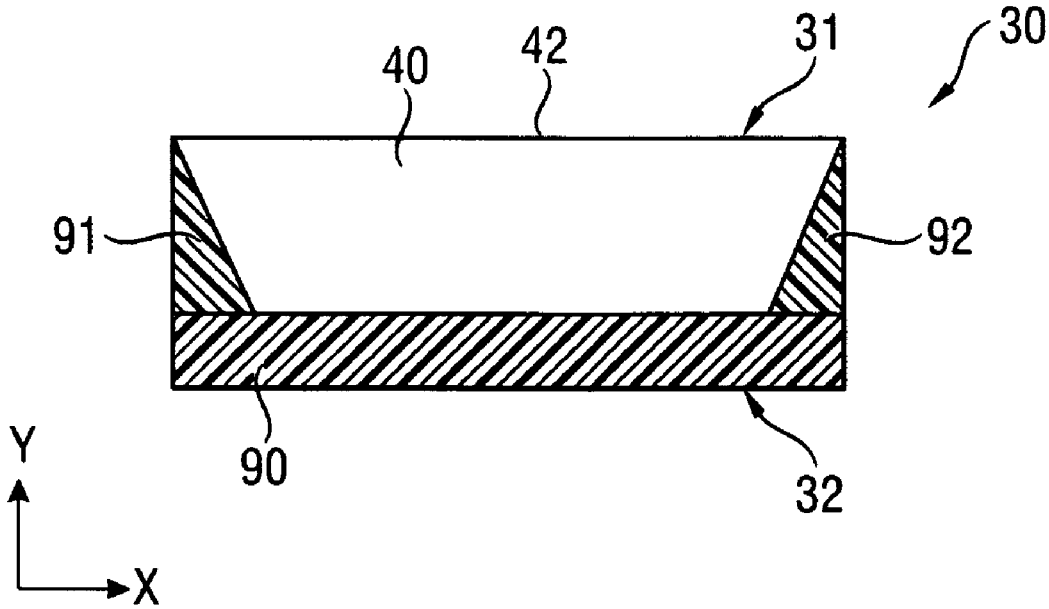
FIG. 3*b* is a cross-sectional view in the X-Y dimension of another mop head according to the present invention.
Figure 4A:
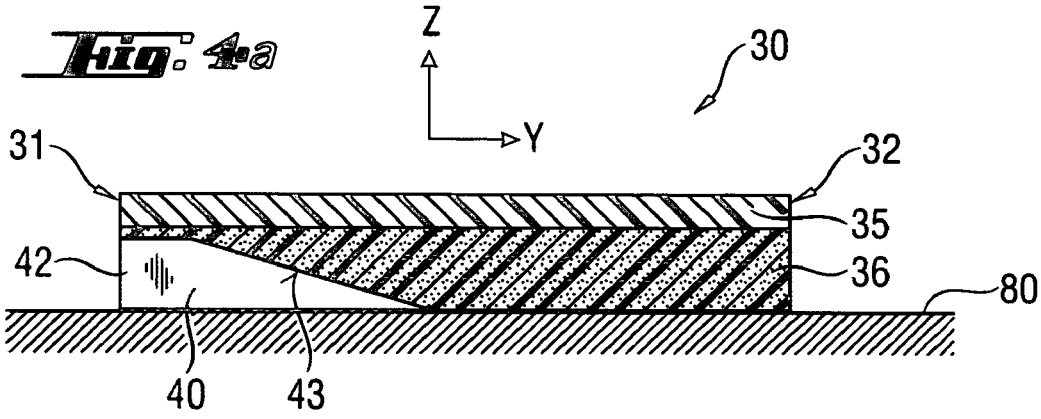
FIGS. 4*a*, 4*b* and 4*c* are a cross-sectional view in the Z-direction of preferred mop heads according to the present invention.

In a preferred embodiment as shown in FIG. 3*b*, the mop head has top, bottom, front and back portions, wherein the bottom portion comprises a longitudinal portion 90 and at least a first and second transversal portion 91, 92 extending from said longitudinal portion substantially towards the front portion, the longitudinal and first and second transversal portions thereby forming a semi-enclosed recess (i.e. a cavity) when the bottom portion is in contact with the surface to be cleaned, such that dust and soil particles are trapped within the semi-enclosed recess when the bottom portion is moved across the surface in a forward direction.

Figure 4B:
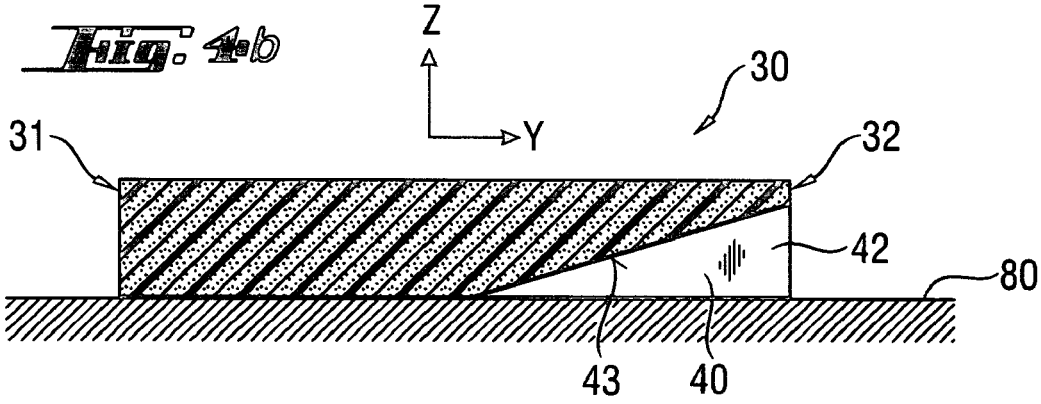

When the opening 42 is formed only adjacent the leading edge 31, it allows a user to immediately collect all the dust and particles in the cavity underneath the mop head 30, when the mop head 30 is moved in a forward, left and right direction. However, since the handle can be attached to the mop head via a joint which allows the mop head to be turned in all directions, it is possible to easily turn the mop head 180 degrees so as to bring the trailing edge in the front direction. Therefore, as an alternative embodiment of the present invention and as shown in FIG. 4*b*, there is provided a cleaning implement for cleaning hard surfaces, comprising a handle connected to a mop head which is at least partially deformable, the mop head having a leading edge connected to a trailing edge, wherein the mop head comprises a first cavity, said first cavity extending from the trailing edge towards the leading edge, said first cavity forming an opening only adjacent the trailing edge when said mop head is in contact with a hard surface to be cleaned, said opening having a width of between about 50% and about 100% of the entire length of the trailing edge. In this embodiment, a dust pile is building up at the leading edge 31 when a user is moving the mop head 30 in a forward, left and right direction. By simply turning the mop head 180 degrees in the X-Y dimension, the user can then easily collect and retain the dust pile by moving the cavity over the dust pile. All the foregoing and following embodiments described for cleaning implements having a mop head with a cavity that forms an opening only adjacent the leading edge when the mop head is in contact with the surface to be cleaned, also apply for this alternative embodiment having a cavity which forms an opening only at the trailing edge when the mop head is in contact with the surface to be cleaned.

To be able to collect various types of soil having different sizes, sometimes with a diameter of up to about 5 mm or even more, the opening 42 should preferably have a height of at least about 5 mm, more preferably at least about 7 mm, even more preferably at least about 10 mm, and up to about 40 mm, preferably up to about 30 mm, and most preferably up to about 20 mm. If the height is lower than about 5 mm, the largest particles will not be entirely collected and retained by the cavity underneath the mop head 30, thereby blocking the opening 42.

The first cavity 40 extends to preferably between about 5% and about 95%, more preferably between about 10% and about 90%, even more preferably between about 20% and about 80%, even more preferably between about 25% and about 75%, and most preferably between about 40% and about 60% of the maximum distance between the leading edge 31 and the trailing edge 32. The most preferred embodiment has a first cavity 40 which extends to about 50% of the maximum distance between the leading edge 31 and the trailing edge 32. The further the cavity extends, the better the soil is being retained in the cavity underneath the mop head 30, thereby reducing the risk of loosing entrapped soil when the mop head 30 is being moved in a left or right direction. When moving the cavity over soil, the soil is traveling towards the end of the cavity, thereby allowing more soil to enter the cavity.

In a preferred embodiment, the cavity has a polygonal shape in the X-Y dimension. The shape of the cavity in the X-Y dimension is preferably selected from the group consisting of a substantially rectangular shape, a substantially trapezoidal shape, a substantially triangular shape, a substantially semi-circular shape, and a substantially semi-elliptical shape. In another preferred embodiment, the first cavity 40 has a shape in the X-Y dimension which converges towards the trailing edge 32 of the mop head 30. A converging shape has the benefit that the soil, especially large particles, is guided to a centralized area, where they can be picked up as will be explained later. While not being limited to theory, it is believed that a converging shape aids in separating larger soil particles from finer dust by centralizing the larger particles, thereby leaving a path for fine dust to travel in a straight direction towards the trailing portion of the mop head 30.

This effect of soil separation is even further enhanced when the first cavity 40 is tapered as shown in FIG. 4*a*. The taper 43 decreases in the Z-direction from the leading edge 31 towards the trailing edge 32 of the mop head 30 when the opening 42 is formed at the leading edge 31, or from the trailing edge 32 towards the leading edge 31 when said opening 42 is formed at the trailing edge 32. The taper 43 preferably starts at the leading edge 31, but could also start at a point more inside the cavity. Because of the taper 43, the largest particles will be separated from smaller particles. In a high preferred embodiment, the first cavity 40 has a converging shape in the X-Y dimension, and is tapered in the Z-dimension, thereby separating fine dust from particles, and larger particles from smaller particles. It is also preferred that the lower surface of the mop head 30 is textured.

Figure 6:
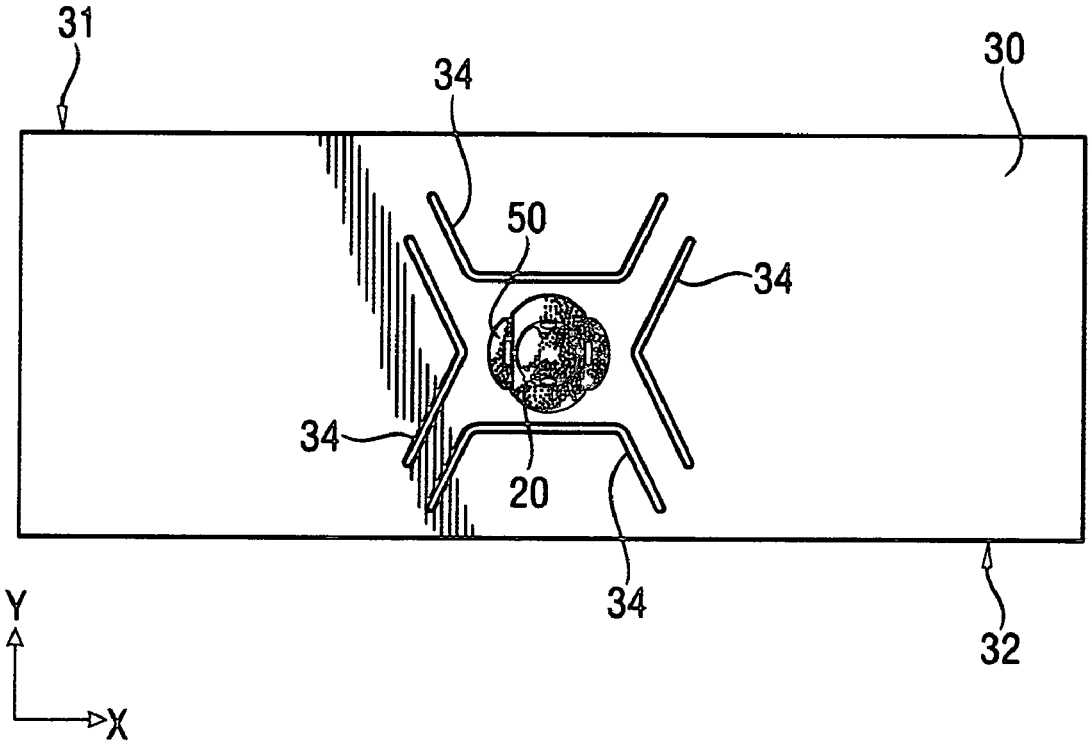
FIG. 6 is a top view of a preferred cleaning implement according to the present invention, having a mop head with slits in its upper surface.

The mop head 30 of the cleaning implement 10 according to the present invention is at least partially deformable. With deformable, it is meant that a user can vertically deform the mop head 30 by pressing down the cleaning implement's 10 handle 20, or by stepping on the mop head 30 with a foot. Preferably, the mop head 30 is at least partially compressible. The mop head 30 should also be resilient, so as to be able to return to its original state. This is necessary to allow a user to perform multiple compression steps, both during one or multiple cleaning operations. The benefit of a deformable or compressible mop head 30 will be explained further. The mop head 30 can be made partially or completely of a resilient, flexible material, partially or completely of a rigid, non-flexible material, or a combination of both. Suitable resilient, flexible materials are for example rubber, EVA, polyethylene, neoprene, PVC, silicone, polyurethane and/or any open/closed cell foam, and the like. Suitable rigid, non-flexible materials are for example hard plastics made of polyethylene, polypropylene, polyester, polyamide (Nylon), polyacetal, PVC, styrene based polymers such as acrylonitrile-butadiene-styrene copolymer; metals, and the like. In order to make a mop head 30 which is made entirely of a rigid, non-flexible material, deformable, the mop head 30 should comprise at least one slit 34 in its upper surface, as shown in FIG. 6. The mop head 30 preferably comprises at least 2 slits 34, more preferably at least 3 slits 34, and even more preferably at least 4 slits 34 in its upper surface. If the mop head 30 is connected to a handle 20 via a pivotable joint 50, it is preferred that the slits are located adjacent the pivotable joint 50, more preferably located around the pivotable joint 50. In a preferred embodiment as shown in FIG. 4*a*, the mop head 30 comprises an upper portion 35 connected to a lower portion 36, wherein the upper portion 35 is made of a rigid, non-flexible material, and the lower portion 36 is made of a resilient, flexible material. The upper portion 35 preferably comprises at least one slit 34.

The location of where the handle 20 is attached to the mop head 30 is important to prevent the mop head 30 from diving during the cleaning operation. With diving it is meant that the mop head 30 collapses when the implement is moved over the surface to be cleaned, which is not desired as this would reduce the height of the opening 42, or even completely close the opening 42. The problem of diving increases when either the opening 42 is very wide with respect to the length of the edge, or when the cavity is large with respect to the size of the mop head 30, or both. Typically in cleaning implements known in the art, the handle 20 is attached to the mop head 30 exactly in the center of the mop head 30. While this may still be the preferred location, it is possible that for some embodiments of the present invention, diving may occur during the wiping operation. In these cases, the handle 20 is preferably attached to the mop head 30 at a location between the center of the mop head 30 and the trailing edge 32. However, in some embodiments it may also be preferred that the handle 20 is attached at a location between the center of the mop head 30 and the leading edge 31. This is for example preferred when the mop head 30 is made of a rigid, non-flexible material.

The first cavity 40 preferably has a continuous shape. It is also possible to have a first cavity 40 which comprises one or more vertical support members to prevent diving of the mop head 30. It is preferred that one support member is positioned in the center of the cavity, along the Y-axis. As a result, the first cavity 40 would form more than one opening 42 at the leading edge 31. In this embodiment, the openings 42 formed at the leading or the trailing edge 32, each must have a width of between about 25% to about 50% of the entire length of the leading or trailing edge 32, so that the total width of the openings is at least about 50% of the entire length of the leading edge. The support members must be small in relation to the size of the cavity such that there is enough space for collecting dust and soil within the cavity. Therefore, the support members may not occupy more than about 20% of the cavity.

Figure 4C:
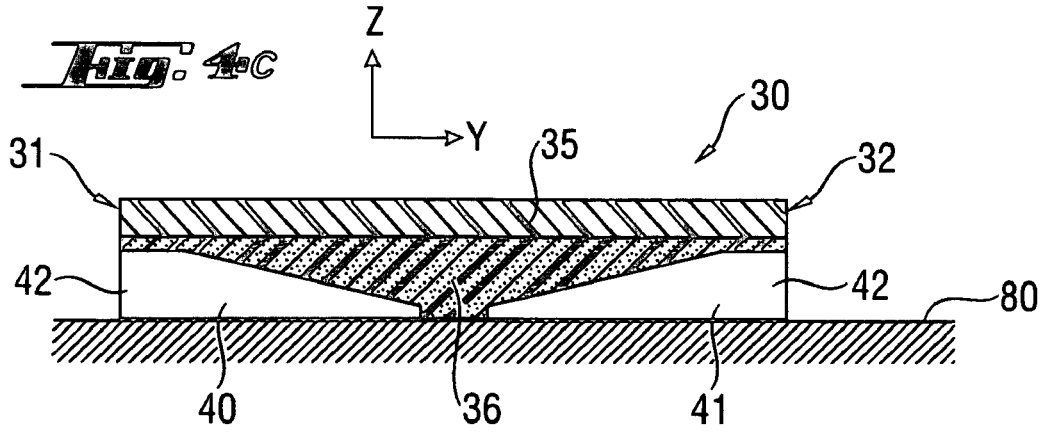

The mop head 30 may further comprise a second cavity 41 as shown in FIG. 4*c*. In one embodiment, the mop head 30 comprises a first cavity 40 which extends from the leading edge 31 towards the trailing edge 32, and a second cavity 41 which extends from the trailing edge 32 towards the leading edge 31. The first cavity 40 forms an opening 42 only adjacent the leading edge 31, while the second cavity 41 forms an opening 42 only adjacent the trailing edge 32, when the mop head 30 is in contact with the hard surface 80 which is to be cleaned. For good performance, the opening 42 formed by the second cavity 41 should have a width of between about 50% and about 100% of the entire length of the mop head's 30 trailing edge 32. Preferred ranges for the width and height of the opening 42 are the same as those specified above for the opening 42 of the first cavity 40. In this embodiment where the mop head 30 comprises a first and second cavity 40, 41, both cavities can extend to between about 5% and about 95% of the maximum distance between the leading edge 31 and the trailing edge 32. However, it is preferred that both cavities extend to between about 5% and about 50%, preferably between about 10% and about 45%, and most preferably between about 20% and about 40% of the maximum distance between the leading edge 31 and the trailing edge 32. Preferred shapes in the X-Y dimension of the second cavity 41 are those earlier described for the first cavity 40. The second cavity 41 can have the same shape and depth as the first cavity 40, or can have a different shape and/or depth. The second cavity 41 is preferably also tapered. The taper 43 decreases in the Z-direction from the trailing edge 32 towards the leading edge 31, and preferably starts at the trailing edge 32, but could also start at a point more inside the cavity. In a more preferred embodiment, the mop head 30 has a first and second cavity 40, 41, each cavity having a taper 43 as described above. The taper 43 of the first cavity 40 may be the same, or different, than the taper 43 of the second cavity 41.

Alternatively, when the mop head 30 has a leading edge 31 connected a trailing edge 32 via two side edges, the second cavity 41 may extend from one side edge towards the opposing side edge, forming an opening 42 only adjacent the side edge when then mop head 30 is in contact with the hard surface 80. It is even possible for such a mop head 30 to have 4 cavities, one extending from the leading edge 31 towards the trailing edge 32, one extending from the trailing towards the leading edge 31, and two extending from a side edge towards the opposing side edge. In another alternative embodiment, the mop head 30 has a triangular shape, and can have 3 cavities forming an opening 42 at each side when the mop head 30 is in contact with the hard surface 80. Even circular shaped mop head 30 could be envisaged having a cavity underneath the mop head 30. In this case, the cavity forms one or more openings 42 only at the circular edge when the mop head 30 is in contact with the hard surface 80, said one or more openings 42 having a width of at least about 25% of the total width of the circumference.

Figure 2:
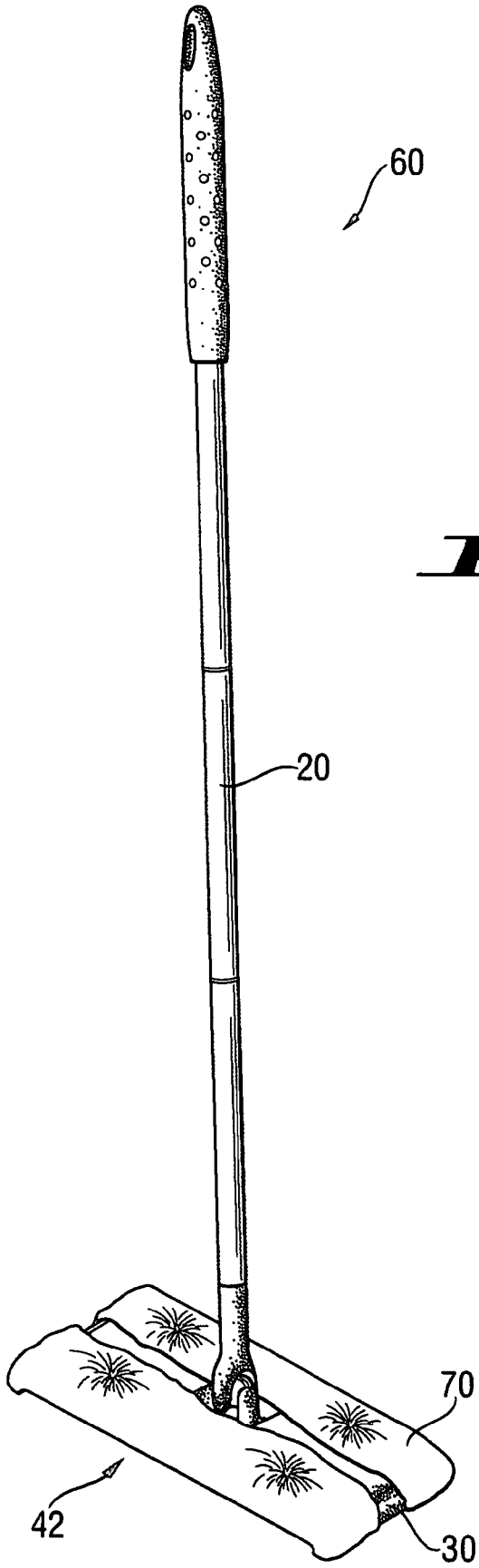
FIG. 2 is a perspective view of a cleaning system according to the present invention, wherein a cleaning sheet is attached to a cleaning implement.

C. Cleaning System:

The cleaning implement 10 as described above is to be used with a cleaning sheet 70. Therefore, the present invention also relates to a cleaning system 60 as shown in FIG. 2, comprising a cleaning implement 10 as described above; and a cleaning sheet 70 removably attached to the mop head 30 of said cleaning implement 10.

Cleaning sheets 70 suitable for use with the cleaning implement 10 are adapted to attract and retain various types of dust and other particulates. For instance, the cleaning sheets 70 are particularly suited for attracting and retaining particles ranging in size from about $1\times10^{-4}$ mm up to larger sized particulates which can be 5 to 10 mm in height.

Any cleaning sheet for dry dusting, as is known in the art or currently available on the market, can be used together with the cleaning implement 10 according to the present invention. Therefore, another aspect of the present invention is to provide a cleaning system 60 for cleaning hard surfaces, comprising a cleaning implement 10 as described above, and a cleaning sheet 70 removably attached to the mop head 30 of the cleaning implement 10. The cleaning sheet 70 typically has a total aggregate basis weight of at least about 20 g/m$^2$, preferably at least about 40 g/m$^2$, and more preferably at least about 60 g/m$^2$. The total aggregate basis weight of the present cleaning sheets 70 is typically no greater than about 275 g/m$^2$, preferably no greater than about 200 g/m$^2$, and more preferably no greater than about 150 g/m$^2$. The cleaning sheet 70 can be made using either a woven or nonwoven process, or by forming operations using melted materials laid down on forms, especially in belts, and/or by forming operations involving mechanical actions/modifications carried out on films. The structures are made by any number of methods (e.g., spunbonded, meltblown, resin bonded, thermal-bonded, air-through bonded, needle-punched etc.), once the desired characteristics are known. However, the preferred structures are nonwoven, and especially those formed by hydroentanglement and/or thermal-bonding as is well known in the art, since they provide highly desirable open structures. Therefore, a preferred cleaning sheet 70 is a nonwoven structure having the characteristics described herein. Materials particularly suitable for forming the preferred nonwoven cleaning sheet 70 of the present invention include, for example, natural cellulosics as well as synthetics such as polyolefins (e.g., polyethylene and polypropylene), polyesters, polyamides, synthetic cellulosics (e.g., RAYON®), and blends thereof. Also useful are natural fibers, such as cotton or blends thereof and those derived from various cellulosic sources, however these are not preferred. Preferred starting materials for making the cleaning sheet 70 are synthetic materials, which may be in the form of carded thermal-bonded, hydroentangled, spunbonded, meltblown, airlaid, or other structures. A cleaning sheet 70 comprising synthetic materials or fibers typically have desirable electrostatic properties, which is preferred. Particularly preferred are polyesters, especially carded polyester fibers. The degree of hydrophobicity or hydrophilicity of the fibers is optimized depending upon the desired goal of the sheet, either in terms of type of soil to be removed, the type of additive that is provided, biodegradability, availability, and combinations of such considerations. In general, the more biodegradable materials are hydrophilic, but the more effective materials tend to be hydrophobic.

The cleaning sheet 70 may be formed from a single fibrous layer, but preferably are a composite of at least two separate layers. A preferred cleaning sheet 70 includes a variety of layer structures, such as heat-bonded layers and/or hydroentangled layers.

The cleaning performance of the cleaning sheet 70 can be further enhanced by treating the fibers of the sheet, especially surface treating, with any of a variety of additives that is selected to enhance the pick up and retention of fine particulate matter typically found on household floors and surfaces such as crumbs, dirt, sand, hair, crushed food, grass clippings and mulch, from surfaces while minimizing the amount of residue left on the surface being cleaned. When utilized, such additives are added to the cleaning sheet 70 at a level sufficient to enhance the ability of the sheet to adhere soils. However, the level and type of additive must be selected to minimize the amount of residue left on the surface being cleaned by the cleaning sheet 70. Typically, the add-on level is from about 0.1 to about 25%, more preferably from about 0.5 to about 20%, more preferably from about 1 to about 15%, still more preferably from about 2 to about 10%, still more preferably from about 4 to about 8%, and most preferably from about 4 to about 6%, by weight of the dry cleaning sheet 70. Preferred additives include surfactants, waxes such as paraffin wax or micro-crystalline wax, oils such as mineral oil, and combinations thereof. These low levels are especially desirable when additives are applied at an effective level and preferably in a substantially uniform way to at least one discrete continuous area of the sheet.

However, improved cleaning performance can be obtained if a cleaning sheet 70 as now will described, is used together with the cleaning implement 10 of the present invention.

Figure 5A:
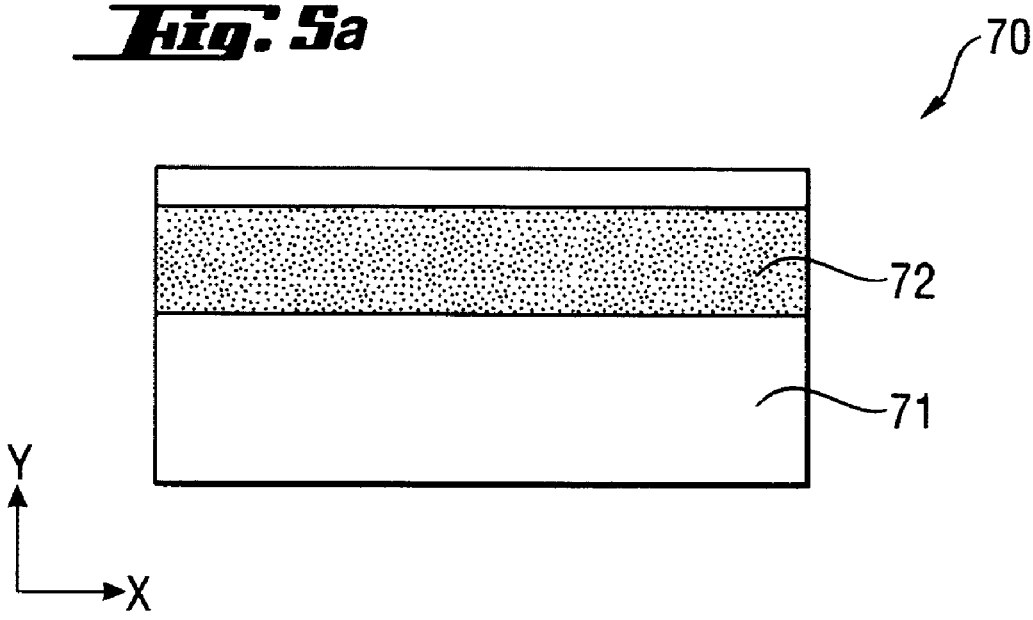
FIGS. 5*a* and 5*b* are an underneath view of preferred cleaning sheets for use with a cleaning implement of the present invention.
Figure 5B:
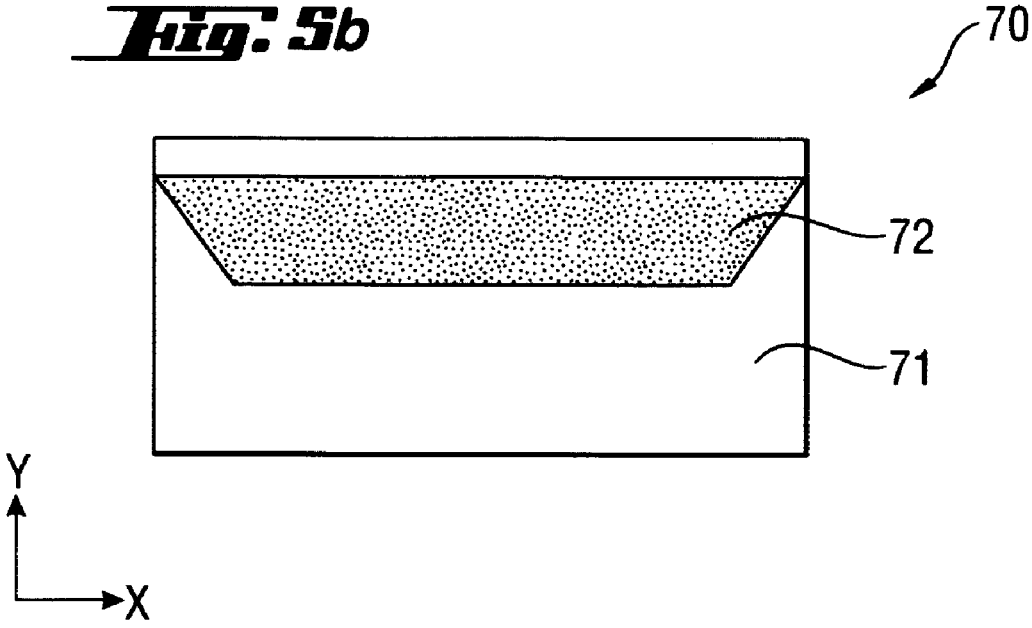

A preferred cleaning sheet 70 for use with the cleaning implement 10 of the present invention, comprises an upper layer 71 and a lower layer 72, as shown in FIGS. 5*a* and 5*b*.

The upper layer 71, which upper surface contacts the mop head 30 when it is attached to the mop head 30, mainly provides fine dust pick-up capability. The upper layer 71 can be a monolayer, or can consist of multiple layers, and can be any of the cleaning sheets 70 described above. The lower layer 72, which is attached to the lower surface of the upper layer 71, is made out of a low density, low basis weight material, and mainly provides larger dry soil particles pick-up capability. The lower layer 72 has a total aggregate basis weight of typically between 15 g/m$^2$ and 45 g/m$^2$, and preferably comprises higher denier filaments or filament blends having a denier of between about 6 and about 60 dpf (denier per filament), preferably between about 12 and about 45 dpf. The lower layer 72 has a density of between about 0.01 g/cm$^3$ and about 0.07 g/cm$^3$, more preferably between about 0.015 g/cm$^3$ and about 0.045g/cm$^3$.

The lower layer 72 is smaller than the upper layer 71, and thus only partially covers the surface of the upper layer 71. As such, a preferred cleaning sheet 70 comprises at least one area for larger dry soil particles pick-up, the remaining area providing fine dust pick-up.

As the cavity of the mop head 30 is designed for collecting and retaining larger dry soil particles, it is preferred that the lower layer 72 covers at least a portion the cavity when the cleaning sheet 70 is attached to the mop head 30. In a highly preferred embodiment, the lower layer 72 has a shape and size which substantially corresponds to the shape and size of the cavity when the cleaning sheet 70 is attached to the mop head 30.

When the mop head 30 comprises a second cavity 41, as explained above, the cleaning sheet 70 comprises a lower layer 72 consisting of two portions, each portion covering at least a portion of the respective cavities, but each preferably having a shape and size corresponding to the shape and size of the respective cavities. When the mop head 30 comprises more than 2 cavities as explained above, the lower layer 72 will have as many portions as there are cavities, each portion of the lower layer 72 covering at least a portion, but preferably corresponding in shape and size, of the respective cavities.

For best cleaning performance, an adhesive is provided between the upper layer 71 and the lower layer 72, and in a region which at least partially, preferably entirely, corresponds with the cavity when the cleaning sheet 70 is attached to the mop head 30. The adhesive is not present in the regions where the lower layer is not present. The adhesive, which does not contact the hard surface 80 during a normal wiping operation, is used for picking up the dust pile, and larger soil particles when the mop head 30 is being pressed against the surface such that the mop head deforms or compresses. Upon compression, the cavity and the lower layer collapse, thereby contacting and adhering the soil particles and/or dust pile. When the pressure is released, the mop head 30 returns to its original state, and the adhesive pulls the some of the soil which is adhered thereto, up through the lower layer 72. The adhesive is preferably chosen such that it does not leave any sticky residue behind on the hard surface 80. Suitable adhesives are those, but not limited to, selected from the group consisting of pressure sensitive adhesives, tacky polymers, and mixtures thereof.

Preferred adhesives in the present invention are pressure sensitive adhesives. Suitable pressure sensitive adhesives generally comprise an adhesive polymer that is optionally in combination with a tackifying resin, plasticizer, and/or other optional ingredients. Pressure sensitive adhesives typically comprise an adhesive polymer, co-polymer, or mixtures of polymers. Suitable pressure sensitive adhesives preferably comprise adhesive polymers and copolymers of synthetic resins, rubbers, polyethylene, polypropylene, polyurethane, acrylics, vinyl acetate, ethylene vinyl acetate and polyvinyl alcohol.

Suitable adhesive polymers include, but are not limited to, block co-polymers containing polystyrene endblocks, and polyisoprene, polybutadiene, and/or poly ethylene-butylene midblocks; polyolefins such as polyethylene, polypropylene, amorphous polypropylene, polyisoprene, and polyethylene propylene; ethylene-vinylacetate copolymers; poly(vinyl ethylene-co-1,4-butadiene); natural rubber [poly cis-isoprene]; polyacrylic acids, preferably 2-ethylhexylacrylate and iso-octlyacrylate, and polymethacrylic acid or their salt; polydimethylsiloxane, polydiphenylsiloxane, poly methyl phenyl siloxane; polyvinyl alcohol; and mixtures thereof. Preferred pressure sensitive adhesives comprise a cross-linked adhesive polymer. A preferred pressure sensitive adhesive comprises a cross-linked acrylate adhesive polymer and is essentially free of tackifying resins, plasticizers, slip agents, or other resins.

Suitable adhesive polymers can further include thermoplastic polymers such as A-B-A triblock copolymers, A-B diblock copolymers, A-B-A-B-A-B multiblock copolymers, radial block copolymers and grafted versions thereof; homopolymers, copolymers and terpolymers of ethylene; and homopolymers, copolymers and terpolymers of propylene; and mixtures thereof. Radial block copolymers include Y-block and star polymers as well as other configurations. The A-B-A block copolymers useful herein are those described in U.S. Pat. No. 4,136,699 issued Jan. 30, 1979 to Collins et al. Examples include those polymers available under the Kraton™ G-and D-series from Shell Chemical Co. in Houston, Tex., including Kraton™ G-1726, G-1650, G-1651, G-1652, G-1657, D-1112, D-1107, D-1111, D4433X, and D1184; Stereon™ 840A and Stereon™ 841A, available from Firestone in Akron, Ohio; Europrene™ Sol T-193B, available from Enichem Elastomers in New York, N.Y.; Europrene™ Sol T-190 and Europrene™ Sol T-163, available from Enichem Elastomers; Vector™ 4461-D, 4111, 4211 and 4411 and 4113, available from Exxon Chemical Co. in Houston, Tex.; and DPX-550, DPX-551 and DPX-552 radial SIS block copolymers available from Dexco Polymers in Houston, Tex. This list in not exclusive and there are numerous grades of block copolymers available from various sources for pressure sensitive adhesives, especially hot melt pressure sensitive adhesives. These polymers may be used alone, or in any combinations. These polymers are useful from about 5% to about 90% by weight of the pressure sensitive adhesive.

Other adhesive polymers include a substantially linear copolymer having the general configuration A-B-A wherein the A block can be polystyrene and the B block can be ethylene-butylene, ethylene-propylene, isoprene, butadiene or mixtures thereof, and preferably the B block is ethylene-butylene or ethylene-propylene. Adhesive polymers of this type have twice the molecular weight of conventional styrene-ethylene/butylene-styrene (S-EB-S) block copolymers also used in pressure sensitive adhesives. This copolymer is typically present in amounts of from about 2% to about 20% by weight, preferably from about 5% to about 20%, by weight of the pressure sensitive adhesive.

Other adhesive polymers include lower molecular weight block copolymers that can be utilized with the high molecular weight block copolymers. Some examples are A-B-A triblock copolymers, A-B diblock copolymers, A-B-A-B-A-B multiblock copolymers, radial block copolymers, and grafted versions of such copolymers including Shell Chemical's TKG-101 and RP-6912. Such A-B-A block copolymers are disclosed in Collins et al., U.S. Pat. No. 4,136,699. Some of these block copolymers are commercially available from Shell Chemical Co. under the Kraton™ G series which are S-EB-S block copolymers.

Other useful adhesive polymers include atactic polyalphaolefins such as those available from Rexene Products Co. in Dallas, Tex. under the tradename of Rextac™ such as RT-2280, RT-2315 and RT-2585 having various amounts of ethylene and homogeneous linear or substantially linear interpolymers of ethylene with at least one C2 to C20 alphaolefin, further characterized by each said interpolymer having a polydispersity less than about 2.5, including such polymers as Exact™ 5008, Exxpol™ SLP-0394, and Exact™ 3031, all available from Dow Chemical Co. in Midland, Mich. These polymers may have to be used in small concentrations if utilized with such block copolymers as Kraton™ G-1651 to maintain compatibility without phase separation or glutinous, gel-like compositions. These concentrations can be as low as 5% by weight of the pressure sensitive adhesive.

Other adhesive polymers useful in the pressure sensitive adhesives are ethylene vinyl acetate copolymers such as Elvax™ 410 and Elvax™ 210, both available from DuPont Chemical Co. in Wilmington, Del.; Escorene™ UL 7505 available from Exxon Chemical Co.; Ultrathene™ UE 64904 available from Quantum Chemical Co., U.S.I. Division in Cincinnati, Ohio; and AT 1850M available from AT Polymers & Film Co. in Charlotte, N.C. Copolymers of ethylene and methyl acrylate (methacrylates as well as acrylates) are also useful including Optema™ TC-140, XS-93.04 and TC-221 available from Exxon Chemical Co.; Lotryl™ 28 MA 175 and 35 MA 05 1000 available from Elf Atochem North America in Philadelphia, Pa. Ethylene methyl acrylate copolymers are also available from Chevron under the tradename of Emac™ and from Quantum Chemical Co. under the tradename of Acrythene™. Copolymers of ethylene and n-butyl acrylate are also useful in the pressure sensitive adhesives of the present invention. They are available from Quantum Chemical Co. under the tradename of Enathene™ including EA80808, EA 89821 and EA89822; from Elf Atochem North America under the tradename of Lotryl™ including 35 BA 900 and 35 BA 1000; from Exxon Chemical Co. under the tradename of Escorene™ including XW-23.AH and XW-22. These adhesive polymers can also have to be used in small concentrations with some of the block copolymers such as Kraton™ G-1651.

In a preferred embodiment, the pressure sensitive adhesive comprises an adhesive polymer that is an acrylic adhesive polymer selected from a wide variety of polymers and copolymers derived from acrylic and/or methacrylic acid, or ester, amide and nitrile derivatives thereof. Mixtures of different polymers and copolymers can be used. These polymers and copolymers preferably have a glass transition temperature of less than about 0° C. so that the mass of polymer is tacky at ambient temperatures. Examples of useful acrylate-based adhesive polymers include homopolymers and copolymers comprising isooctylacrylate, 2-ethylhexylacrylate, isoamylacrylate, nonylacrylate and butylacrylate and their copolymers or terpolymers with acrylic acid, methacrylic acid, acrylamide, methacrylamide, acrylonitrile and methacrylonitrile. It is also possible to incorporate nonpolar acrylic monomers whose homopolymers have a relatively high $T_g$ such as, for example, isobornylacrylate (see, e.g., WO 95/13,331 and WO 95/13,328).

Other adhesive polymers include polyamides; polyesters; polyvinyl alcohols and copolymers thereof; polyurethanes; polystyrenes; polyepoxides; graft copolymers of vinyl monomers and polyalkylene oxide polymers and; aldehyde containing resins such as phenol-aldehyde, urea-aldehyde, melamine-aldehyde and the like.

Suitable pressure sensitive adhesives can optionally be formulated with tackifying resins in order to improve adhesion and introduce tack into the pressure sensitive adhesive, to achieve the adhesive characteristics desired herein. Such resins include, among other materials, (a) natural and modified resins, (b) polyterpene resins, (c) phenolic modified hydrocarbon resins, (d) coumarone-indene resins, (e) aliphatic and aromatic petroleum hydrocarbon resins, (f) phthalate esters and (g) hydrogenated hydrocarbons, hydrogenated rosins, and hydrogenated rosin esters. Tackifying resins in hot melt adhesives that are solid at room temperature, but melt below application temperatures are preferred, since these resins lower the viscosity on application resulting in improved distribution and anchoring of the adhesive to the substrate, while not having excessive fluidity at ambient temperature during usage. Preferably, these resins have a melting point between about 35° C. and about 200° C., more preferably between about 50° C. and about 150° C.

While tackifying resins are preferable for use in hot melt pressure sensitive adhesives, tackifying resins can also be utilized in other types of pressure sensitive adhesives as well. The tackifying resins useful herein further include aliphatic, cycloaliphatic and aromatic hydrocarbons and modified hydrocarbons and hydrogenated derivatives; terpenes and modified terpenes and hydrogenated derivatives; rosins and modified rosins and hydrogenated derivatives; and mixtures thereof. There are many available types and grades of tackifying resins available from many companies, and one skilled in the art would recognize that the available tackifying resins are too numerous to list here. These tackifiers are useful in pressure sensitive adhesives at a level of from about 0% to about 65%, preferably from about 10% to about 65%, by weight of the pressure sensitive adhesive.

Pressure sensitive adhesives can optionally comprise plasticizers. The plasticizers useful in the present pressure sensitive adhesives include, but are not limited to, mineral based oils and petroleum based oils, liquid resins, liquid elastomers, polybutene, polyisobutylene, functionalized oils such as glycerol trihydroxyoleate and other fatty oils and mixtures thereof. A plasticizer is broadly defined as a typically organic composition that can be added to pressure sensitive adhesives, such as those that comprise thermoplastics, rubbers and other resins, to improve extrudability, flexibility, workability and stretchability in the finished pressure sensitive adhesive. Any material which flows at ambient temperatures and is compatible with the block copolymer may be useful. The most commonly used plasticizers are oils which are primarily hydrocarbon oils that are low in aromatic content and are paraffinic or naphthenic in character. The oils are preferably low in volatility, transparent and have as little color and odor as possible. Plasticizers are useful in the pressure sensitive adhesives at levels of from about 0% to about 50% by weight of the pressure sensitive adhesive.

Desirable optional components in the present pressure sensitive adhesives include diluents, e.g., liquid polybutene or polypropylene, petroleum waxes such as paraffin and microcrystalline waxes, polyethylene greases, hydrogenated animal, fish and vegetable fats, mineral oil and synthetic waxes such as hydrocarbon oils such as naphthionic or paraffinic mineral oils.

Examples of preferred pressure sensitive adhesives are sold under the trade name HL-1496, HL-1500, HM-1597, HM-1902, HM-1972, HM-2713, available from H. B. Fuller Company.

Other highly preferred pressure sensitive adhesives are hot melt pressure sensitive adhesives, especially those described in U.S. Pat. No. 6,448,303 (C. W. Paul) and U.S. Pat. No. 5,559,165 (C. W. Paul), and both assigned to National Starch and Chemical Investment Holding Corporation. U.S. Pat. No. 5,559,165 describes a wide range of hot melt pressure sensitive adhesives comprising a high molecular weight block copolymer and 60-95 parts by weight of an oil or another liquid midblock diluent, which result in adhesives that fall within the range of a Tg less than −10° C., an elastic modulus G' of less than $15\times10^4$ dynes/cm$^2$ at 10 rad/s at 25° C., and a loss modulus G" of 1 to $6\times10^4$ dynes/cm$^2$ and a tensile strength greater than 10 psi and requiring no subsequent curing operation after cooling. U.S. Pat. No. 6,448,303 describes hot melt pressure sensitive adhesives comprising a high molecular weight rubber less than about 60 parts by weight of a liquid diluent and having a G' less than $15\times10^4$ dynes/cm$^2$ at 10 rad/s at 25° C. An example of a highly preferred hot melt pressure sensitive adhesive is Dispomelt™ C0596 81A from National Starch.

The adhesives can also be tacky polymers. Tacky polymers are also sometimes included in pressure sensitive adhesive compositions as an optional ingredient. In a preferred embodiment herein, a tacky polymer is itself a suitable adhesive.

Tacky polymers suitable for use as an adhesive for the cleaning sheets 70 herein include, but are not limited to, polymers selected from the group consisting of: polyisobutylene polymers, alkyl methacrylate polymers, polyalkyl acrylates, and mixtures thereof, wherein the alkyl groups are $C_2$-$C_{18}$, preferably $C_2$-$C_{12}$. Preferred tacky polymers are poly n-decyl methacrylate, poly ethyl acrylate, poly n-butyl acrylate, and mixtures thereof More preferred tacky polymers herein are polyisobutylene polymers. Examples of preferred tacky polymers for use in the present cleaning sheets 70 herein include, but are not limited to, poly(n hexylmethacrylate); p-2-ethylhexyl methacrylate; polyethylacrylate; poly (lauryl acrylate); poly(n butyl acrylate); polyisobutylene ("PIB"); poly(1,4-butylene adipate); poly(n decylmethacrylate); poly(octadecylmethacrylate); poly(lauryl acrylate); poly(n butyl acrylate); poly(n-decylmethacrylate; and mixtures thereof.

The amount of adhesive impregnated onto the present cleaning sheets 70 (between the upper and lower layer) is another important consideration in obtaining a cleaning sheet 70 that exhibits acceptable particulate pick-up, minimal residue, and glide. Typically, the adhesive is impregnated onto the present cleaning sheets 70 at a level of adhesive of no greater than about 80.0 g/m$^2$, preferably no greater than about 50.0 g/m$^2$, more preferably no greater than about 40.0 g/m$^2$, and still more preferably no greater than about 30.0 g/m$^2$. Preferably, the adhesive is impregnated onto the present cleaning sheets 70 at a level of adhesive of 25.0 g/m$^2$. Note that the amount of adhesive applied to the cleaning sheet 70 does not include the amount of solvent used to solubilize the adhesive. If the level of adhesive is too high, the cleaning sheet 70 will feel sticky, resulting in hand feel that is aesthetically unacceptable to household consumers. Also, if the level of adhesive is too high, the cleaning sheet 70 will not glide easily across the surface being cleaned, and will tend to leave a residue on the surface, resulting in filming and/or streaking of the surface that is visually unacceptable to consumers. Also, the adhesives are typically impregnated onto the present cleaning sheets 70 at a level of adhesive of at least about 10.0 g/m$^2$, preferably at least about 20.0 g/m$^2$. If the adhesive is impregnated onto the cleaning sheet 70 at a level that is too low, the cleaning sheet 70 will tend not to exhibit significantly improved particulate pick-up, with respect to cleaning sheets 70 that contain no adhesive.

D. Method for Cleaning Hard Surfaces

The cleaning system 60 described above, is used for cleaning hard surfaces, especially dry dust-type cleaning of floor surfaces. Accordingly, the present invention also provides a method of cleaning a hard surface 80, comprising the step of wiping the surface with the cleaning system 60 described above. The method further comprises the step of moving the mop head 30 in a direction such that particles are collected and retained within said first cavity 40. Preferably, the method further comprises the step of pressing the mop head 30 to the surface to be cleaned, during the wiping operation and/or after the wiping operation. This step deforms or compresses the mop head, allowing to pick up larger dry soil particles, and a dust pile which builds up during the wiping operation.

EXAMPLES

A cleaning system according to the present invention comprising a cleaning implement, and a cleaning sheet removably attached to it, was made (referred to as "A"). The cleaning system had the following characteristics:

- the mop head has a leading edge with a width of 263 mm, connected to a trailing edge via two side edges, each side edge having a width of 113 mm. The mop head had an upper portion of rigid plastic material, connected to a lower portion made of resilient, flexible material. A cavity was formed extending from the leading edge towards the trailing edge, the cavity forming an opening at the leading edge when the mop head was in contact with a hard surface. The opening had a width of 239 mm, and a height of 13 mm. The cavity had a tapered trapezoidal shape, and extended 79 mm towards the trailing edge.
- a cleaning sheet having an upper layer and a lower layer, and an adhesive between the two layers. The upper layer is a Swiffer Dry cleaning sheet as currently sold by the Procter & Gamble Company. The lower layer was a 30 gsm carded through-air bonded 90/10 blend of 45 dpf polyester/1.5 dpf bicomponent fiber. The lower layer had a rectangular shape, and a size such that it only covered the entire cavity when attached to the cleaning implement. The adhesive was a pressure sensitive adhesive, H.B. Fuller HL1461-XZP.

A Swiffer Dry cleaning system as currently sold by the Procter & Gamble Company, was used for a comparative test (referred to as "Comp. B"). The cleaning implement has a mop head with a slightly curved lower surface, thereby forming a gap at the leading edge having a height of 4 mm. The cleaning sheet is the same sheet as was used for the upper layer of the cleaning system described above.

Soil Preparation:

The following soil was prepared:

(1) 0.1 g of vacuum cleaner soil (VCS), obtained from Empirical Manufacturing Co., Cincinnati, Ohio (i.e. dirt collected from vacuum cleaner bags).

(2) 1.5 g of Froot Loops® Cereal, crushed and sifted to 2-20 mm (one loop was not crushed).

For each test, about 1.6 g of soil is weighed. The weight is recorded as Soil Weight.

Surface Preparation:

A 3 foot by 4 foot (0.91 m by 1.22 m) section of vinyl flooring is cleaned by wiping the entire surface with 20% isopropyl alcohol solution and a paper towel. Before the soil is distributed, the surface is dried. The soil is evenly spread over the surface.

General Procedure:

1. Weigh the cleaning sheet to be tested by placing it in a tared glass beaker on the analytical balance and record weight. Attach the sheet on the appropriate mop head and begin by placing the mop head in the lower left corner of the floor section.

2. Push the cleaning system ahead in a pattern according to below diagram. The mop head should be kept in constant contact with the floor. The mop head should travel back and forth for the length of the floor, and index one width of the mop head in the cross direction, each time the end of the floor is reached.

3. When the entire surface is wiped according to the above diagram (i.e. when point X in the lower right corner is reached).

4. Press the handle downwards to compress the mop head.

5. Pick up the mop head from the surface approximately 6-12 inches and remove the cleaning sheet from the mop. Remove the cleaning sheet by releasing it from the implement attachment structures and fold the sheet into thirds in a way that it contains the soil (to ensure that no soil is lost while removing it from the mop head).

6. Reweigh the soiled cleaning sheet on an analytical balance in a similar way as described in 1.

Results:

The data is reported as % Soil Pickup=(final sheet weigth−initial sheet weight)/soil weight For each cleaning system, 5 replicas were carried out according to above procedure.

| | Repl. 1 | Repl. 2 | Repl. 3 | Repl. 4 | Repl. 5 | Average |
|---|---|---|---|---|---|---|
| A | 99.42% | 98.73% | 96.56% | 95.44% | 97.87% | 97.60% |
| Comp. B | 15.74% | 12.91% | 12.37% | 14.09% | 10.93% | 12.58% |

Cleaning system A showed significant better cleaning results as Comparative system B. Comparative system B was not able to pick up the larger particles, while system A picked up all the particles. System A also showed better usage of the entire surface area of the cleaning sheet.

All documents cited in the Detailed Description of the Invention are, are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning implement suitable for cleaning hard surfaces with a removably attachable sheet, comprising a handle connected to a mop head which is at least partially deformable, said mop head having a leading edge connected to a trailing edge by two side edges, characterized in that said mop head comprises a cleaning surface in the x-y plane and a z direction orthogonal thereto, said cleaning surface having a first cavity not extending to either side edge of said head, said first cavity extending from the leading edge towards the trailing edge, said first cavity forming an opening only adjacent the leading edge when said mop head is in contact with a hard surface to be cleaned, said opening having a width of between at least 50% and less than 100% of the entire length of the leading edge, wherein said first cavity has a shape in the x-y plane, which cavity converges towards the center of said mop head, and further has a taper which decreases in the z-direction, from the leading edge towards the trailing edge of said mop head.

2. A cleaning implement according to claim 1, wherein said mop head is at least partially compressible.

3. A cleaning implement according to claim 1, wherein said opening has a width of between 70% and 99% of the entire length of the leading edge.

4. A cleaning implement according to claim 1, wherein said first cavity extends to between 5% and 95% of the maximum distance between the leading edge and the trailing edge.

5. A cleaning implement according to claim 1, wherein said first cavity has a shape in the x-y dimension selected from the group consisting of a a substantially trapezoidal shape, a substantially triangular shape, a substantially semi-circular shape, and a substantially semi-elliptical shape.

6. A cleaning implement according to claim 1, wherein said opening has a height of between 5 mm and 40 mm.

7. A cleaning implement according to claim 1, wherein said mop head is made at least partially of a resilient, flexible material; a rigid, non-flexible material; or a combination of both.

8. A cleaning implement according to claim 1, wherein said mop head comprises an upper portion connected to a lower portion, wherein said upper portion is made of a rigid, non-flexible material, and the lower portion is made of a resilient, flexible material.

9. A cleaning implement according to claim 1, wherein said mop head further comprises at least one slit in the mop head's upper surface.

10. A cleaning implement according to claim 1, wherein said handle is attached to the upper surface of said mop head at a location between the trailing edge and the center of said mop head.

11. A cleaning implement according to claim 1, wherein said mop head further comprises a second cavity extending from the trailing edge towards the leading edge, said second cavity forming an opening only adjacent the trailing edge when said mop head is in contact with said hard surface, said opening having a width of between 50% and 100% of the entire length of the trailing edge, said second cavity extending to between 5% and 95% of the maximum distance between the leading edge and the trailing edge.

12. A cleaning implement according to claim 11, wherein said second cavity has a shape in the x-y dimension selected from the group consisting of a substantially rectangular shape, a substantially trapezoidal shape, a substantially triangular shape, a substantially semi-circular shape, and a substantially semi-elliptical shape.

13. A cleaning implement according to claim 11, wherein said second cavity has a shape in the x-y dimension which converges towards the leading edge of said mop head.

14. A cleaning implement according to claim 11, wherein said second cavity further comprises a taper which decreases in the z-direction from the trailing edge towards the leading edge of said mop head.

15. A cleaning system for cleaning hard surfaces, comprising a. a cleaning implement according to claim 1, and b. a cleaning sheet removably attached to the mop head of said cleaning implement.

16. A cleaning system according to claim 15, wherein the cleaning sheet comprises an upper layer and a lower layer, said lower layer comprising a low density, low basis weight nonwoven material having a basis weight of between 15 and 45 $g/m^2$, and a density of between 0.01 $g/cm^3$ and 0.07 $g/cm^3$.

17. A cleaning system according to claim 16, wherein said lower layer covers at least a portion of said first cavity, and at least a portion of a second cavity if present.

18. A cleaning system according to claim 16, wherein said lower layer has a shape corresponding to the shape of said first cavity, and to the shape of a second cavity if present.

19. A cleaning system according to claim 16, further comprising an adhesive between said upper layer and lower layer.

20. A cleaning system according to claim 19, wherein said adhesive is selected from the group consisting of pressure sensitive adhesives, tacky polymers, and mixtures thereof.

21. A method of cleaning a hard surface comprising the step of wiping the surface with the cleaning system of claim 15.

22. A method according to claim 21, further comprising the step of moving the mop head in a direction such that particles are collected and retained within said first cavity.

23. A method according to claim 21, further comprising the step of pressing the mop head against the surface to be cleaned, during the wiping operation, and/or after the wiping operation.

* * * * *

UNITED STATES PATENT AND TRADEMARK OFFICE

CERTIFICATE OF CORRECTION

PATENT NO. : 7,607,192 B2
APPLICATION NO. : 11/189243
DATED : October 27, 2009
INVENTOR(S) : Flora et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1127 days.

Signed and Sealed this

Twelfth Day of October, 2010

David J. Kappos

David J. Kappos
*Director of the United States Patent and Trademark Office*